US010052790B2

(12) United States Patent
Asakura et al.

(10) Patent No.: US 10,052,790 B2
(45) Date of Patent: Aug. 21, 2018

(54) MICROWAVE DRYING METHOD OF HONEYCOMB FORMED BODY

(71) Applicant: NGK INSULATORS, LTD., Nagoya (JP)

(72) Inventors: Norihiro Asakura, Nagoya (JP); Kensuke Okumura, Nagoya (JP); Seiichiro Hayashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 178 days.

(21) Appl. No.: 15/077,067

(22) Filed: Mar. 22, 2016

(65) Prior Publication Data

US 2016/0288365 A1 Oct. 6, 2016

(30) Foreign Application Priority Data

Mar. 31, 2015 (JP) ..... 2015-071545

(51) Int. Cl.
*F26B 3/347* (2006.01)
*B28B 11/24* (2006.01)
*H05B 6/80* (2006.01)

(52) U.S. Cl.
CPC ..... *B28B 11/241* (2013.01); *B28B 11/243* (2013.01); *F26B 3/347* (2013.01); *H05B 6/80* (2013.01); *F26B 2210/02* (2013.01); *H05B 2206/046* (2013.01)

(58) Field of Classification Search
CPC .... F26B 3/347; F26B 2210/02; B28B 11/241; B28B 11/243; H05B 6/80; H05B 2206/046
See application file for complete search history.

(56) References Cited

U.S. PATENT DOCUMENTS 6,932,932 B2 8/2005 Miura et al.
7,197,839 B2 4/2007 Terazawa et al.
7,371,977 B1 * 5/2008 Preonas ..... H05K 9/0041 174/383
2002/0093123 A1 7/2002 Miura et al.
(Continued)

FOREIGN PATENT DOCUMENTS

JP 2002-283329 A1 10/2002
JP 2006-088685 A1 4/2006
(Continued)

OTHER PUBLICATIONS

Extended European Search Report (Application No. 16161732.9) dated Oct. 21, 2016.

*Primary Examiner* — Jessica Yuen
(74) *Attorney, Agent, or Firm* — Burr & Brown, PLLC

(57) ABSTRACT

A microwave drying method of a honeycomb formed body includes: an introduction step of disposing the honeycomb formed body while keeping an axis direction of cells of the honeycomb formed body vertically and introducing the honeycomb formed body into a drying furnace capable of irradiating with microwaves; a reflector placing step of placing a microwave reflector above the honeycomb formed body, the microwave reflector including a reflecting face having a coverage factor to an area of an end face of the honeycomb formed body that is 15% to 30%; and a microwave drying step of irradiating the honeycomb formed body with the microwaves of 915 MHz in frequency from above to dry the honeycomb formed body.

6 Claims, 3 Drawing Sheets

(56) References Cited

U.S. PATENT DOCUMENTS

| | | | | |
|---|---|---|---|---|
| 2002/0109269 | A1 | 8/2002 | Miura et al. | |
| 2006/0042116 | A1 | 3/2006 | Terazawa et al. | |
| 2011/0227256 | A1* | 9/2011 | Okumura ..... | F26B 3/343 264/414 |

FOREIGN PATENT DOCUMENTS

| | | | |
|---|---|---|---|
| JP | 2012-066404 | A1 | 4/2012 |
| JP | 2013-180412 | A1 | 9/2013 |

* cited by examiner

MICROWAVE DRYING METHOD OF HONEYCOMB FORMED BODY

The present application is an application based on JP 2015-071545 filed on Mar. 31, 2015 with the Japan Patent Office, the entire contents of which are incorporated herein by reference.

BACKGROUND OF THE INVENTION

Field of the Invention

The present invention relates to a microwave drying method of a honeycomb formed body. More specifically, the present invention relates to a microwave drying method of a honeycomb formed body to dry a honeycomb formed body by means of microwaves.

Description of the Related Art

Conventionally, honeycomb structures made of ceramic have been used for a wide range of purposes, including a catalyst carrier to purify exhaust gas from automobiles, a filter to remove diesel particulates, and a heat storage member for combustion devices, for example. Such a honeycomb structure made of ceramic (hereinafter simply called a "honeycomb structure") is manufactured by cutting a honeycomb formed body, which is prepared by extruding a forming material (kneaded material) prepared beforehand using an extrusion machine into a desired shape, into individual pieces of honeycomb formed bodies, followed by the steps of drying and end-face finishing, and then a firing step to fire at a high temperature. A large-sized honeycomb structure to which the present invention is particularly favorably applicable, additionally includes the steps of, following the firing step, grinding the circumferential part of the honeycomb structure to adjust the radial dimension thereof as well as to remove defects at the circumferential part, and applying a coating material to the ground circumferential part and drying to form a circumferential wall.

For a drying step to dry a honeycomb formed body, a microwave drying method is used, which is to irradiate the honeycomb formed body with microwaves. In this method, as drying progress, the water content becomes less and the drying efficiency deteriorates, and so hot air drying is used in combination as the final drying (see Patent Documents 1, 2).

In recent years, the development of a honeycomb structure having low pressure loss has been demanded for the purpose of improving the fuel consumption and making the purification performance more efficient. In order to lower pressure loss, the partition wall making up cells of the honeycomb structure has to be made thinner, and the cross section of the honeycomb structure has to be made larger. In this respect, a honeycomb structure is loaded with a catalyst, and when the catalyst is loaded on the surface of the partition wall, the partition wall including the catalyst layer will be thick substantially, and so pressure loss after loading with catalyst increases. In order to make the catalyst layer at the surface of a partition wall as thin as possible, the partition wall is required to have higher porosity as well so as to allow more catalyst to be loaded in the pores of the partition wall. In order to manufacture a honeycomb structure including a thin wall of higher porosity, more pore former has to be added to the forming material. Since a water absorbable pore former is used to make the fluidity of the forming raw material favorable during extrusion, the honeycomb formed body will contain more water.

[Patent Document 1] JP-A-2002-283329

[Patent Document 2] JP-A-2006-88685

SUMMARY OF THE INVENTION

Along with an increase in water content included in the honeycomb formed body and an increase in size thereof, penetration of microwaves to the center part of the honeycomb formed body is prevented, and so drying hardly progresses at the center part. The honeycomb formed body contracts due to drying, and if drying is delayed at the center part, the center part will receive pressure from the circumferential part and the end-face part. Since the strength of the honeycomb formed body having a thinner partition wall deteriorates, cells at the center part of such a honeycomb formed body tend to be deformed due to the pressure. Such deformation of the cells at the center part of the honeycomb formed body is transmitted to the end-face part of the honeycomb formed body along the cell direction, which greatly degrades the mechanical strength of the honeycomb structure. To improve the penetration of microwaves into the center part of the honeycomb formed body, microwaves of a lower frequency can be used. For instance, the frequency is changed from 2,450 MHz to 915 MHz, whereby the penetration property can be improved.

Meanwhile, when a conventional honeycomb formed body containing more water is dried at 915 MHz, microwaves penetrate into the center part of the honeycomb formed body excessively, so that a phenomenon is found that the center part of the honeycomb formed body is overheated. If the center part is overheated, drying and contraction at the center part precede so that the circumferential part and the end-face part are pulled out from the center part, and as a result, cells are deformed at the end-face part. In order to dry a wide range of honeycomb formed bodies while setting the frequency of microwaves at 915 MHz, some measures corresponding to the types of honeycomb formed body are required.

Microwaves are reflected on the inside of a drying furnace, and are incident on the circumferential part and the end-face part of the honeycomb formed body. According to a "microwave drying method of honeycomb formed bodies" disclosed in Patent Document 2, it is disclosed that a difference in drying speed inside of the honeycomb formed body is decreased during the drying step of the formed body, whereby deformation of the cells can be suppressed. Specifically, a honeycomb formed body is placed in a tubular shelter to reflect microwaves so as to control the incident density in the vertical direction (end-face direction) and the incident density in the horizontal direction (side-face direction) of the honeycomb formed body, and a difference in drying speed in the vertical direction of the honeycomb formed body can be reduced, and a difference in drying speed in the radial direction of the honeycomb formed body can be suppressed. In this case, however, since microwaves are incident only from the vertical direction of the honeycomb formed body, deformation of cells will occur inside of the honeycomb formed body similarly to the related art of the present application described later, and so such a technique cannot be applied.

Then in view of such circumstances, the present invention aims to provide a microwave drying method of a honeycomb formed body that, when the honeycomb formed body is dried by irradiating with microwaves, reduce the temperature gradient inside of the formed body, whereby no defects, such as deformation of cells of the honeycomb formed body, occur.

According to the present invention, a microwave drying method of a honeycomb structure is provided.

According to a first aspect of the present invention, a microwave drying method of a honeycomb formed body is provided, including: an introduction step of disposing the honeycomb formed body while keeping an axis direction of cells of the honeycomb formed body vertically and introducing the honeycomb formed body into a drying furnace capable of irradiating with microwaves; a reflector placing step of placing a microwave reflector having a function to reflect the microwaves and including a reflecting face having a coverage factor to an area of an end face of the honeycomb formed body that is 15% to 30% so as to face an upper end face of the honeycomb formed body; and a microwave drying step of irradiating the honeycomb formed body with the microwaves of 915 MHz in frequency from above to dry the honeycomb formed body.

According to a second aspect of the present invention, the microwave drying method of a honeycomb formed body according to the first aspect is provided, wherein at the microwave drying step, the honeycomb formed body is dried so that temperature during temperature rising of the honeycomb formed body is controlled by the microwave reflector so that temperature is higher at a center part of the upper end face than at a circumferential part of the honeycomb formed body, and so that in a cross section in a length direction including a barycenter of the honeycomb formed body, a temperature difference between at the barycenter and at the center part is 25° C. or less.

According to a third aspect of the present invention, the microwave drying method of a honeycomb formed body according to the first or second aspects is provided, wherein the honeycomb formed body irradiated with the microwaves includes a ratio of water content included in the honeycomb formed body before drying that is in a range of 20 to 30%.

According to a fourth aspect of the present invention, the microwave drying method of a honeycomb formed body according to any one of the first to third aspects is provided, wherein the honeycomb formed body irradiated with the microwaves has a honeycomb diameter of 195 mm or more and a honeycomb length of 75 mm or more.

According to a fifth aspect of the present invention, the microwave drying method of a honeycomb formed body according to any one of the first to fourth aspects is provided, wherein the microwave reflector includes a metal material.

According to a sixth aspect of the present invention, the microwave drying method of a honeycomb formed body according to any one of the first to fifth aspects is provided, wherein the microwave reflector is made up of a flat-plate-shaped member, and includes a plurality of through holes penetrating from the reflecting face and a reflecting back surface of the microwave reflector, and the through holes have a diameter that is ¾ or less of a wavelength of the microwaves irradiated.

According to the microwave drying method of a honeycomb formed body of the present invention, the microwave reflector is disposed so as to face the upper end face of the honeycomb formed body, whereby a temperature difference between the center part of the formed body and the end face and the lateral face of the formed body can be reduced, and defective shapes, such as cell deformation at around the center part of the formed body can be suppressed especially.

DESCRIPTION OF THE PREFERRED EMBODIMENTS

Figure 1:
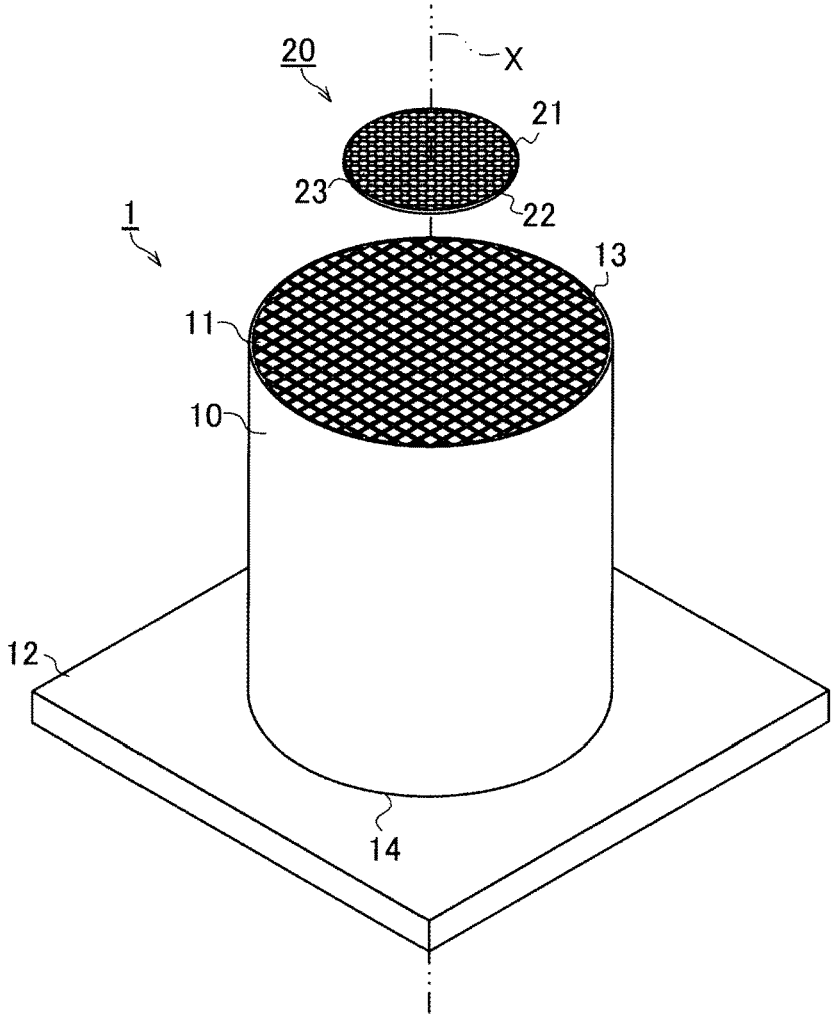
FIG. 1 schematically shows one example of a microwave reflector disposed above a honeycomb formed body.

The following describes embodiments of a microwave drying method of a honeycomb formed body of the present invention, with reference to the drawings. The present invention is not limited to the following embodiments, to which changes, modifications and improvements may be added without deviating from the scope of the invention.

A microwave drying method of a honeycomb formed body that is one embodiment of the present invention (hereinafter simply called a "drying method 1") includes an introduction step of introducing a honeycomb formed body 10 into a drying furnace (not illustrated), a reflector placing step of placing a microwave reflector 20 around the honeycomb formed body 10 introduced, and a microwave drying step of irradiating the honeycomb formed body 10 to which the microwave reflector 20 is disposed with microwaves to dry the honeycomb formed body 10.

More specifically, the introduction step of the drying method 1 is to introduce a honeycomb formed body 10 into a drying furnace, the honeycomb formed body being formed through extrusion of a forming material prepared beforehand using an extrusion machine and cutting it into a predetermined length. The honeycomb formed body 10 is placed on a rectangular flat-plate-shaped conveyance pallet 12 while keeping the axis direction X of cells 11 (corresponding to the center axis direction of the honeycomb formed body 10, see FIG. 1) vertically. Herein, the ratio of water included in the forming material used for extrusion of the honeycomb formed body 10 is set in the range of 20 to 30%. Herein, the honeycomb formed body 10 to be irradiated with microwaves used has a honeycomb diameter of at least 195 mm and a honeycomb length of at least 75 mm.

The conveyance pallet 12 travels in the horizontal direction along the conveyance path defined between the inlet and the outlet of the drying furnace. Therefore, the honeycomb formed body 10 placed on the conveyance pallet 12 is introduced into the drying furnace along the horizontal direction, travels at a predetermined conveyance speed, and is led out through the outlet finally.

The conveyance speed of the conveyance pallet 12 traveling along the conveyance path is controlled, whereby the staying time of the honeycomb formed body 10 in the drying furnace is adjusted, and so the irradiation time of microwaves to evaporate water content included in the honeycomb formed body 10 can be controlled.

A plurality of such configurations each including the conveyance pallet 12 and the honeycomb formed body 10 is disposed so as to be connected to the conveyance path, whereby the plurality of honeycomb formed bodies 10 can be dried continuously. For the configuration used in the present embodiment, such as a drying furnace, a microwave irradiation device (not illustrated) capable of irradiating with microwaves, and a conveyance pallet 12, existing devices can be used as they are. In a microwave dryer, microwaves are introduced and applied from a waveguide tube into the dryer, are reflected and diffused by a metal reflecting plate provided in the dryer, and are incident on the honeycomb formed body 10. A microwave dryer is mainly to diffuse microwaves uniformly and typically is not configured to control the incident direction to the honeycomb formed body 10.

Meanwhile the reflector placing step is to place the microwave reflector 20 equipped with a function of reflecting microwaves with respect to the honeycomb formed body 10 introduced into the furnace so that the microwave reflector faces the upper end face 13 of the honeycomb formed body 10. Microwaves as one type of electromagnetic waves typically have a property that, when they are applied to a metal material, they cannot enter into the metal material, and are reflected at the surface of the metal material. For instance, the microwave reflector 20 used in the present embodiment may be made of stainless steel, steel plate, aluminum, or other well-known metal materials.

In the drying method 1 of the present embodiment, although the shape, the thickness or the like of the microwave reflector 20 used are not limited especially, it has to be formed to have a size such that the coverage factor R % (=R2/R1×100) of the area R2 of a reflecting face 21 of the microwave reflector 20 to the area R1 of the upper end face 13 of the honeycomb formed body 10 is in the range of 15 to 30%, and in the range of 19 to 29% more preferably. With this configuration, during induction drying, incidence of microwaves of a relatively low frequency (=915 MHz) on the end face 13 can be reliably shielded by the microwave reflector 20 as stated above. Further the shape of the microwave reflector 20 may be of a circular-plate shape along the end face shape of the end face 13 of the honeycomb formed body 10 as shown in FIG. 1, for example, or may be a flat-plate rectangular shaped microwave reflector 20*a* (see FIG. 3).

Since reflection of microwaves occurs at the surface (reflecting face 21) of the microwave reflector 20 as stated above, there is no need that the entire microwave reflector 20 is made of a metal material as stated above. That is, a substrate (not illustrated) of the microwave reflector 20 may be made of a non-metal material, and then the surface of the substrate may be coated with aluminum foil or copper foil, for example, to form the reflecting face 21, paint including a metal material may be applied to the surface of the substrate, or a metal coating may be formed by plate processing.

The microwave reflector 20 used in the drying method 1 of the present embodiment is made up of a circular flat-plate-shaped member as shown in FIG. 1 or the like. A plurality of through holes 23 of a circular shape in cross section is bored so as to penetrate from the reflecting face 21 facing the honeycomb formed body 10 to a reflecting back surface 22 opposed to the reflecting face 21. The through holes 23 facilitate the release of water vapor from the end face of the honeycomb formed body 10 to which the microwave reflector 20 is disposed.

The through holes 23 of a circular shape in cross section have the diameter that is set to be ¾ or less of the wavelength X of microwaves that a microwave oscillator generates in the drying furnace. Such a diameter of the through holes to be ¾ or less of the wavelength X prevents microwaves W irradiated from the side of the reflecting back surface 22 from passing through the through holes 23. As a result, the microwaves incident on the honeycomb formed body 10 can be shielded by the microwave reflector 20.

Figure 2:
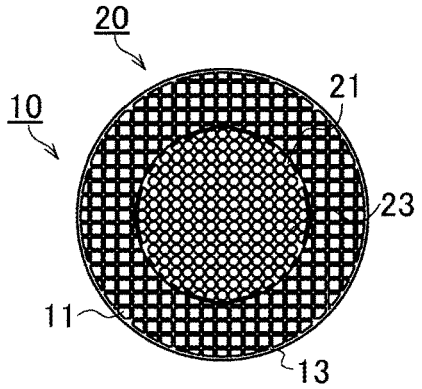
FIG. 2 is a plan view of the above showing an example of the microwave reflector disposed above the honeycomb formed body.

The thus configured microwave reflector 20 is disposed so as to face the upper end face 13 of the honeycomb formed body 10 introduced into the drying furnace. In the drying method 1 of the present embodiment, the microwave reflector 20 is directly placed on the upper end face 13 (see FIG. 2) so as to face the upper end face 13 of the honeycomb formed body 10, in which the axis direction X of the cells 11 is kept along the vertical direction.

The microwave reflector 20 may be disposed with respect to the honeycomb formed body 10 so that the end face 13 and the reflecting face 21 are separated from each other. In this case, the microwave reflector 20 is disposed at a position above the end face 13 and allowing the shielding effect from the microwave reflector 20 to be kept. Note here that, if the end face 13 and the reflecting face 21 are separated from each other by 100 mm or more, the shielding effect of the microwave reflector 20 will be lost.

The microwave drying step is to irradiate the honeycomb formed body 10 to which the microwave reflector 20 is disposed above the end face 13 as stated above with microwaves W of 915 Hz in frequency, so as to evaporate water content included in the honeycomb formed body 10 and dry the honeycomb formed body 10.

The microwave reflector 20 is disposed so as to face the upper end face 13 of the honeycomb formed body 10, whereby temperature rising at the center part of the honeycomb formed body 10 can be suppressed, and so a difference in temperature gradient inside of the formed body can be reduced. That is, this can suppress a phenomenon that the temperature at a region close to the center part of the honeycomb formed body becomes high locally, and such a region only is dried earlier than the surrounding. Thereby, defects, such as cell deformation generated inside of the honeycomb formed body, can be reduced.

When the microwave reflector 20 is disposed so as to face the upper end face 13 of the honeycomb formed body 10 as shown in FIG. 1, microwaves irradiated to the honeycomb formed body 10 from above are reflected by the microwave reflector 20 provided at the end face 13 of the honeycomb formed body 10. Thereby, an incidence of the microwaves on the upper end face 13 of the honeycomb formed body 10 facing the microwave reflector 20 is inhibited.

Since microwaves of 915 MHz in frequency reduce in electric power to be half at a deep part, unless the microwave reflector 20 of the present embodiment is placed so as to face the upper end face 13, microwaves will penetrate excessively to a part close to the center part 15 of the honeycomb formed body 10. As a result, the temperature rises quickly in the region of the center part 15 of the formed body as compared with the end face 13. According to the microwave drying method 1 of the present embodiment, however, the microwave reflector 20 as stated above is placed so as to face the end face 13, such microwaves reaching the region of the center part 15 of the formed body can be suppressed. Therefore, a temperature difference between the center part 15 of the formed body and the end face and the lateral face of the formed body can be reduced.

If the shielding effect from the microwave reflector 20 is too intensive, the temperature at the center part of the upper end face 13 of the honeycomb formed body 10 may be lower than that at the circumferential part. In that case, the temperature rise is delayed at the center part of the end face 13, so that cell deformation occurs at the center part. Therefore, the temperature at the center part of the end face 13 has to be kept higher than the temperature at the circumferential part.

Accordingly the size and the position of the microwave reflector 20 are set appropriately, whereby temperature during the temperature rising process of the honeycomb formed body can be controlled so as to avoid the above-mentioned phenomenon that the temperature is reversed between the center part and the circumferential part of the upper end face of the honeycomb formed body, and so that a temperature difference between at the barycenter and at the center part of the upper end face in a cross section in the length direction including the barycenter of the honeycomb formed body is 25° C. or less. The temperature difference between at the barycenter and at the center part of the upper end face is preferably controlled to be 20° C. or less.

As described above, according to the drying method 1 of the present embodiment, the microwave reflector 20 is disposed with respect to the honeycomb formed body 10 introduced to the drying furnace so as to face the upper end face 13, whereby temperature rises inside of the formed body can be controlled so that a temperature difference between the center part 15 of the formed body and the end face and the lateral face of the formed body can be reduced. Thereby, defects, such as cell deformation due to drying and contraction occurring during typical microwave drying from a part around the end face in the depth direction especially, can be suppressed.

The drying method 1 of the present embodiment does not require any new special facility to be added, and can exert the excellent effect as stated above with simple modification of disposing the microwave reflector 20 at a predetermined position with respect to the honeycomb formed body 10 using an existing drying furnace or the like, and so without increasing the cost for facility, for example.

The following describes the microwave drying method of a honeycomb formed body of the present invention, by way of the following Examples, and the microwave drying method of a honeycomb formed body of the present invention is not limited to these Examples.

EXAMPLES (1) Honeycomb Formed Body

For Examples 1 to 4 and Comparative Examples 1 to 5, the honeycomb formed bodies were used, including the cordierite component formed under the same condition. Since the details of the forming step to form such honeycomb formed bodies are well known, their detailed descriptions are omitted. The honeycomb formed bodies of Examples 1 to 3 and Comparative Examples 1, 3 and 4 had a honeycomb diameter of 385 mm, and the honeycomb formed bodies of Example 4 and Comparative Examples 2 and 5 had a honeycomb diameter of 320 mm. They had a honeycomb length of 330 mm. The ratio of water content (water-containing ratio) included in the honeycomb formed body with reference to the weight of the honeycomb formed body before drying was 24%. Note here that these dimensions were values before drying.

(2) Microwave Drying Conditions

The honeycomb formed bodies formed by the above (1) according to Examples 1 to 4 and Comparative Examples 1 to 5 were introduced into a drying furnace for induction drying, and were irradiated with microwaves so as to evaporate water content included in the honeycomb formed bodies, thus performing drying of the honeycomb formed bodies. The frequency of microwaves applied to the honeycomb formed bodies was set at 915 MHz, and the other drying conditions were the same for all. The output power of microwaves was set at 234 kW, and 10 to 15 pieces of the honeycomb formed bodies were loaded into the drying furnace. The irradiation amount of microwaves per unit weight was about 1.5 kW/kg, and variations of the irradiation amount of microwaves per unit weight were about ±10% during the drying step. Herein, the scattering ratio in Table 1 is the ratio of water content removed at the microwave drying with reference to the weight of the honeycomb formed body before drying. This means that, out of 24% of the water-containing ratio, 23% was removed by the microwave drying, and the remaining 1% was removed by hot-air drying.

(3) Microwave Reflector

During drying with microwaves in the above (2), microwave reflectors that were made of different materials and had different sizes and shapes were placed at the upper end faces of the honeycomb formed bodies of Examples 1 to 4 and Comparative Example 1 to 5, and the depth (generation position) of cell deformation generated during drying was measured from the upper end face of each honeycomb formed body. Herein, for Examples 1, 4 and Comparative Examples 3, 4, a microwave reflector made of stainless steel was used, for Example 2, a microwave reflector made of a steel plate was used, and for Example 3 and Comparative Example 5, a microwave reflector made of aluminum was used. Thereby, depth of cell deformation depending on a difference in materials of the microwave reflector can be examined.

Further, for Examples 1 and 2, a circular microwave reflector of 170 mm in diameter was used, and the coverage factor R that was the ratio of the area of the reflecting face of the microwave reflector to the area of the end face of the honeycomb formed body having a honeycomb diameter of 385 mm was 19.5%. For Example 4, a circular-plate-shaped microwave reflector of 170 mm in diameter was used similarly, and the coverage factor R to the honeycomb formed body having a honeycomb diameter of 320 mm was 28.2%. Similarly, for Comparative Example 3, a circular microwave reflector of 120 mm in diameter was used, and the coverage factor R was 9.71%, and for Comparative Example 4, a circular microwave reflector of 220 mm in diameter was used, and the coverage factor R was 32.7%

Figure 3:
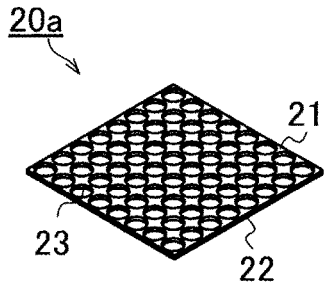
FIG. 3 is a perspective view showing another example of the configuration of a microwave reflector.
Figure 4:
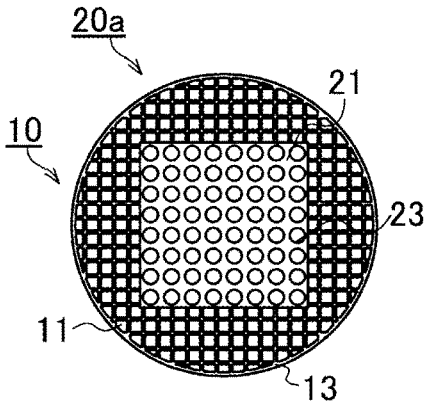
FIG. 4 is a plan view showing an example of the microwave reflector having the other configuration in FIG. 3 that is disposed above the honeycomb formed body.

Meanwhile, for Example 3 and Comparative Example 5, a rectangular microwave reflector 20*a* of 170 mm in length× 160 mm in width was used, and their coverage factors R were 23.4% (Example 3) and 33.8% (Comparative Example 5) (see FIGS. 3 and 4). Herein, Comparative Example 1 and Comparative Example 2 did not include a microwave reflector for comparison with Examples 1 to 4.

As described above, the microwave reflector had a plurality of through holes penetrating from the reflecting face to the reflecting back surface. The open frontal area of each microwave reflector, i.e., the ratio of the total pore area of the through holes to the area of the reflecting face of the microwave reflector was set at about 35 to 40%.

(4) Temperature Measurement Inside of Formed Body

To examine a temperature change at various portions inside of the honeycomb formed body by means of the microwave reflector, a temporal change of the temperature inside of the honeycomb formed body introduced into the drying furnace was measured. The temperature inside of the formed body was measured by embedding a button battery type ultra-small temperature recorder (product name: Super-thermochron, produced by KN Laboratories, Inc.) directly into the honeycomb formed body, and loading temperature data acquired by such an ultra-small temperature recorder into a computer for analysis, whereby a temperature change inside of the formed body in the drying furnace was measured.

Figure 5:
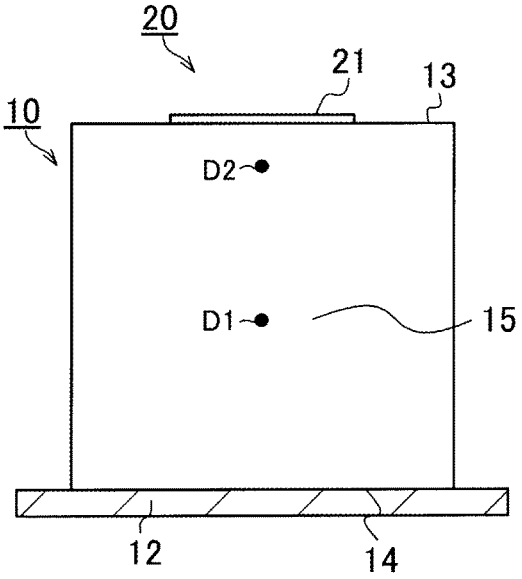
FIG. 5 explains the temperature measurement positions inside of a honeycomb formed body that is placed on a conveyance pallet.

As shown in FIG. 5, the ultra-small temperature recorder was disposed at two positions including a position below from the upper end face (upper part D2) and at a barycenter position of the honeycomb formed body (barycenter D1), which were along the center axis direction of the honeycomb formed body. The temperature measurement range by the ultra-small temperature recorder was 0 to 120° C.

The following Table 1 shows the microwave drying conditions shown in the above (1) to (3) and the results of microwave drying of the honeycomb formed bodies.

immediately after introduction into the drying furnace, after some time elapsed since the introduction, the temperature at the barycenter D1 started to rise. Subsequently, behind at the barycenter D1, the temperature at the upper part D2 rose gently. It is shown that the microwave reflector disposed above the honeycomb formed body successfully controlled a temperature difference between the barycenter D1 and the upper part D2 to be 25° C. or less (see Table 1). The graph in FIG. 7 shows the results of temperature measurement at the barycenter D1 and at the upper part D2 inside of the formed body during microwave drying, to which no microwave reflector was disposed (Comparative Example 1). In comparison between FIG. 6 and FIG. 7, it is shown that the microwave reflector of 170 mm in diameter placed above the honeycomb formed body having a honeycomb diameter of 385 mm could suppress the temperature difference between the barycenter D1 and the upper part D2 by about 10° C. On the contrary, in the case of Comparative Examples 1 to 5, it was found that the temperature difference between the barycenter and the upper part exceeded 25° C.

(5-2) Depth of Cell Deformation (Generation Position)

As shown in Table 1, when the microwave reflector was placed above the honeycomb formed body (Examples 1 to 4), their depth of cell deformation from the upper end face

TABLE 1

| | Items | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 |
|---|---|---|---|---|---|---|---|---|---|---|---|
| Microwave drying conditions | Honeycomb diameter | mm | 385 | 385 | 385 | 320 | 385 | 320 | 385 | 385 | 320 |
| | Honeycomb length | mm | 330 | 330 | 330 | 330 | 330 | 330 | 330 | 330 | 330 |
| | Partition wall thickness | mm | 0.076 | 0.076 | 0.076 | 0.10 | 0.076 | 0.10 | 0.076 | 0.076 | 0.10 |
| | Cell density | cells/$cm^2$ | 600 | 600 | 600 | 400 | 600 | 400 | 600 | 600 | 400 |
| | Product weight in raw condition | kg | 13 | 13 | 13 | 9 | 13 | 9 | 13 | 13 | 9 |
| | Water-containing ratio | % | 24 | 24 | 24 | 24 | 24 | 24 | 24 | 24 | 24 |
| | Scattering ratio | % | | | | | 23 | | | | |
| | Frequency | MHz | | | | | 915 | | | | |
| | Size of microwave reflector | mm | Φ170 | Φ170 | 170 × 160 | Φ170 | — | — | Φ120 | Φ220 | 170 × 160 |
| | Through hole diameter of microwave reflector | mm | φ5 | φ5 | φ5 | φ5 | — | — | φ5 | φ5 | φ5 |
| | Material of microwave reflector | — | SUS | steel plate | Al | SUS | not used | not used | SUS | SUS | Al |
| | Coverage factor R( = R2/R1 × 100) | % | 19.5 | 19.5 | 23.4 | 28.2 | 0 | 0 | 9.71 | 32.7 | 33.8 |
| | Disposition position of microwave reflector | — | upper | upper | upper | upper | — | — | upper | upper | upper |
| | Open frontal area of microwave reflector | % | 35.4 | 35.4 | 40.3 | 35.4 | — | — | 35.4 | 35.4 | 40.3 |
| Evaluation results | Temperature difference between center part and circumferential part | ° C. | 3 | 4 | 6 | 4 | 7 | 5 | 15 | 12 | 13 |
| | Temperature difference between barycenter and center part | ° C. | 20 | 15 | 15 | 12 | 31 | 27 | 27 | 36 | 23 |
| | Depth of cell deformation | mm | 19 | 13 | 27 | 30 | 53 | 75 | 32 | 55 | 60 |

Figure 6:
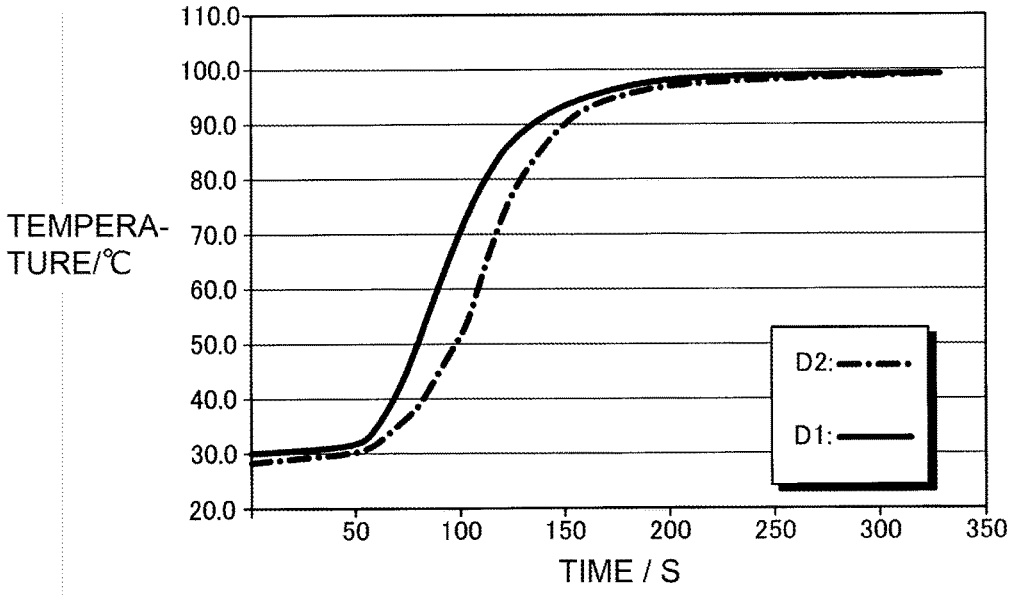
FIG. 6 is a graph showing the temperature measurement result inside of a honeycomb formed body according to Example 1 during microwave drying of the formed body using a microwave reflector.
Figure 7:
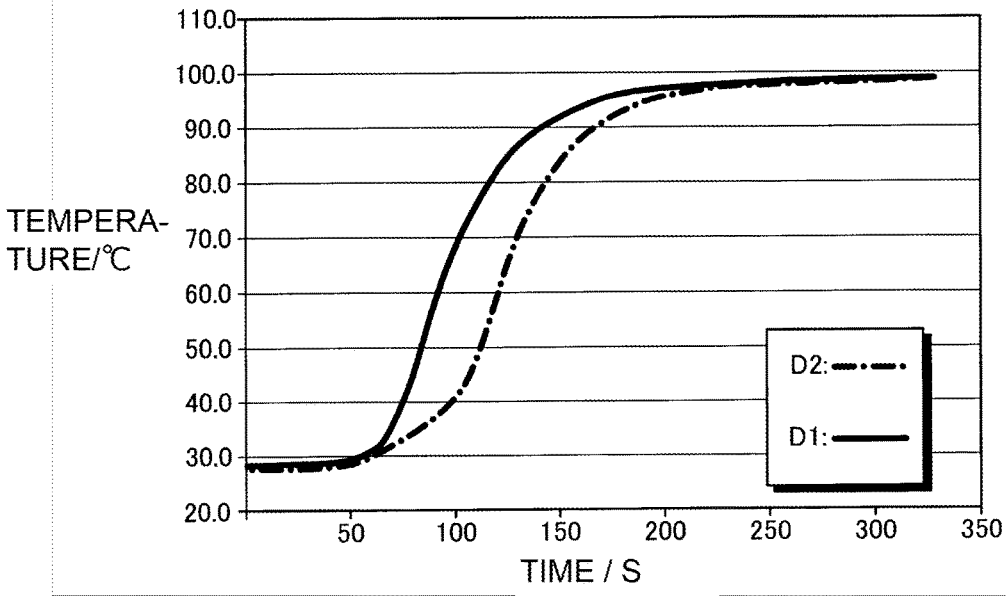
FIG. 7 is a graph showing the temperature measurement result inside of a honeycomb formed body according to Comparative Example 1 during microwave drying of the formed body without using a microwave reflector.

(5) Results of Drying of Honeycomb Formed Body (5-1) Delay of Temperature Rising at the Center Part of the Formed Body The graph in FIG. 6 shows the results of temperature measurement inside of the formed body during microwave drying, to which a microwave reflector was disposed above thereof (Example 1). The horizontal axis of the graph represents the elapsed time since the introduction into the drying furnace. The graph shows that, although a difference in temperature hardly was found between the temperature measurement positions (upper part D2 and barycenter D1)

of the honeycomb formed bodies were all 30 mm or less. On the contrary, when no microwave reflector was placed, cell deformation was found at 53 mm (Comparative Example 1) and 74 mm (Comparative Example 2). In this way, the microwave reflector disposed allows cell deformation to be generated in the vicinity of the upper end face of the honeycomb formed body. The depth of cell deformation is suppressed to 30 mm or less from the end face, whereby such a region of cell deformation can be removed by grinding at the end face performed later. Note here that, in Examples 1 and 2, a large difference was not found in depth of cell deformation depending on materials of the microwave reflector used.

Further, as shown in Comparative Examples 3 to 5, if the coverage factor R of the reflecting face of the microwave reflector to the end face of the honeycomb formed body was low (less than 15%), and was high (exceeding 30%), their depth of cell deformation exceeded 30 mm. In other words, the area of the reflecting face of the microwave reflector is set within the range of 15 to 30% of the end face of the honeycomb formed body, whereby the depth of cell twisting can be suppressed to 30 mm or less. Especially as shown in Example 1 and Example 2, the coverage factor R set at 19.5% is preferable because it allows the depth of cell deformation to be 20 mm or less. No special relationship between a difference in shape of the microwave reflector and the depth of cell deformation was shown.

As described above, according to the microwave drying method of a honeycomb formed body of the present invention, a microwave reflector having a function to reflect microwaves is disposed above the end face of the honeycomb formed body, whereby temperature rises inside of the formed body can be controlled, and especially a center part of the formed body can reach the drying temperature later than at the end face. Thereby, temperature gradient inside of the formed body can be reduced and drying inside of the formed body can progress uniformly, whereby defective shapes, especially deformation of cells generated at a deep position from the end face, can be suppressed effectively.

The microwave drying method of a honeycomb formed body of the present invention is applicable to dry a honeycomb formed body that is formed to manufacture a honeycomb structure, which can be favorably used as a carrier for catalyst devices or as a filter in the various fields such as automobiles, chemical, electric power, and steel.

DESCRIPTION OF REFERENCE NUMERALS

1: drying method (microwave drying method of honeycomb formed body), 10: honeycomb formed body, 11: cell, 12: conveyance pallet, 13, 14: end face, 15: center part of formed body, 20, 20*a:* microwave reflector, 21: reflecting face, 22: reflecting back surface, 23: through hole, D1: barycenter, D2: upper part, X: axis direction.

What is claimed is:

1. A microwave drying method of a honeycomb formed body, comprising:

an introduction step of disposing the honeycomb formed body while keeping an axis direction of cells of the honeycomb formed body vertically and introducing the honeycomb formed body into a drying furnace capable of irradiating with microwaves;

a reflector placing step of placing a microwave reflector having a function to reflect the microwaves and including a reflecting face having a coverage factor to an area of an end face of the honeycomb formed body that is 15% to 30% so as to face an upper end face of the honeycomb formed body; and a microwave drying step of irradiating the honeycomb formed body with the microwaves of 915 MHz in frequency from above to dry the honeycomb formed body, wherein the coverage factor includes the central axis of the honeycomb formed body in a longitudinal direction.

2. The microwave drying method of a honeycomb formed body according to claim 1, wherein at the microwave drying step, the honeycomb formed body is dried so that temperature during temperature rising of the honeycomb formed body is controlled by the microwave reflector so that temperature is higher at a center part of the upper end face than at a circumferential part of the honeycomb formed body, and so that in a cross section in a length direction including a barycenter of the honeycomb formed body, a temperature difference between at the barycenter and at the center part is 25° C. or less.

3. The microwave drying method of a honeycomb formed body according to claim 1, wherein the honeycomb formed body irradiated with the microwaves includes a ratio of water content included in the honeycomb formed body before drying that is in a range of 20 to 30%.

4. The microwave drying method of a honeycomb formed body according to claim 1, wherein the honeycomb formed body irradiated with the microwaves has a honeycomb diameter of 195 mm to 385 mm and a honeycomb length of 75 mm to 330 mm.

5. The microwave drying method of a honeycomb formed body according to claim 1, wherein the microwave reflector includes a metal material.

6. The microwave drying method of a honeycomb formed body according to claim 1, wherein the microwave reflector is made up of a flat-plate-shaped member, and includes a plurality of through holes penetrating from the reflecting face and a reflecting back surface of the microwave reflector, and the through holes have a diameter that is ¾ or less of a wavelength of the microwaves irradiated.

* * * * *